United States Patent [19]

Wischusen, III

[11] Patent Number: 4,651,919

[45] Date of Patent: Mar. 24, 1987

[54] CARTON WITH GUSSETTED COVER PANELS AND A HANDLE

[75] Inventor: Henry Wischusen, III, Lilburn, Ga.

[73] Assignee: Rock-Tenn Company, Norcross, Ga.

[21] Appl. No.: 693,595

[22] Filed: Jan. 22, 1985

[51] Int. Cl.[4] ..... B65D 45/00; B65D 5/46

[52] U.S. Cl. ..... 229/45 R; 229/52 B

[58] Field of Search ..... 229/52 B, 45 R

[56] References Cited

U.S. PATENT DOCUMENTS

| | | | |
|---|---|---|---|
| 637,642 | 11/1899 | Morgan . | |
| 661,071 | 11/1900 | O'Meara . | |
| 717,775 | 1/1903 | Single . | |
| 1,061,531 | 4/1911 | Emmons . | |
| 1,494,361 | 5/1924 | Lambert | 206/45.29 |
| 2,002,005 | 10/1933 | Gottlieb . | |
| 2,638,262 | 5/1953 | Mulnix | 229/52 B |
| 2,650,751 | 6/1951 | Goers . | |
| 2,805,019 | 9/1957 | Muhs et al. | 229/52 B |
| 2,805,813 | 9/1957 | Rittmueller | 229/52 B |
| 2,884,181 | 4/1959 | McCormick . | |
| 3,006,527 | 10/1958 | Lofquist, Jr. . | |
| 3,146,933 | 11/1960 | Moore . | |
| 3,166,235 | 1/1965 | Schroeder | 229/52 B |
| 3,306,520 | 2/1967 | Allard | 229/45 |
| 3,365,114 | 6/1966 | Macchi . | |
| 3,722,782 | 3/1973 | Collie | 229/52 B |
| 3,743,169 | 7/1973 | Person . | |
| 3,921,896 | 11/1975 | Ishimura | 229/52 B |
| 4,054,203 | 10/1977 | Farquhar . | |
| 4,199,098 | 4/1980 | Lopez . | |
| 4,238,069 | 12/1980 | Morris, Jr. | 229/52 B |
| 4,265,393 | 5/1981 | Orchard | 229/45 R |
| 4,307,834 | 12/1981 | Roccaforte | 229/45 R |
| 4,403,728 | 9/1983 | Koltz | 229/52 B |
| 4,482,052 | 11/1984 | Wischusen, III . | |

FOREIGN PATENT DOCUMENTS

| | | | |
|---|---|---|---|
| 272792 | 1/1967 | Australia . | |
| 76724 | 5/1947 | Czechoslovakia | 229/52 B |
| 848447 | 1/1939 | France | 229/52 B |
| 2399360 | 4/1979 | France | 229/52 B |
| 289495 | 3/1965 | Netherlands | 229/52 B |
| 915935 | of 1903 | United Kingdom | 229/52 B |
| 487996 | 6/1938 | United Kingdom | 229/52 B |
| 1385484 | 2/1975 | United Kingdom | 229/52 B |

*Primary Examiner*—Joseph Man-Fu Moy
*Attorney, Agent, or Firm*—Jones & Askew

[57] ABSTRACT

A top-loading carton of paperboard or the like is constructed from a one-piece blank and enclosed by gusseted top panels. The top panels end in handles which define locking tabs which are received in slots in the side walls of the carton. The gusset panels urge the locking tabs into locking engagement with the slots. The end walls and top panels attached thereto taper outwardly from bottom to top of the carton, causing the side walls to bow outwardly when the top panels are closed, enhancing the appearance of the carton. The carton can be initially assembled into a collapsed flattened form from which it can be easily erected. An automatic bottom closure is provided.

10 Claims, 5 Drawing Figures

CARTON WITH GUSSETTED COVER PANELS AND A HANDLE

TECHNICAL FIELD

The present invention relates to a top-loading container for paperboard or the like, and more particularly relates to a container having gussetted fold-in top panels to enclose the container and a handle.

BACKGROUND ART

Paperboard containers having a basket-like configuration with cover panels forming a handle at the center of the container are known. Such a container is shown in U.S. Pat. No. 4,238,069, which discloses a body portion in the shape of an inverted truncated pyramid, a pair of cover panels foldable into the center of the container from opposite sides, and handle members attached to the cover panels. The handles define upstanding projections over which slotted members attached to side panels can be passed to prevent upward movement of the handles and cover panels. In the assembled configuration the container can be lifted by grasping the handles together. Another container having a similar shape and cover panels, but without a handle construction, is shown in U.S. Pat. No. 2,342,543.

Providing gussets on cover panels is known in other contexts. For example, overlapping cover panels have been gussetted to form a slot for receiving the other cover panel in order to maintain the cover panels in a closed position.

SUMMARY OF THE INVENTION

The present invention provides an improved top-loading, enclosed container with locking cover means, all constructed from a single blank of paperboard or the like. Generally described, the invention provides, in a carton including a side wall and a top panel foldably connected along a first edge thereof to a first portion of an upper edge of the side wall, the top panel being foldable to at least partially enclose the carton, the improvement comprising a locking tab extending from the top panel, the side wall defining a slot adjacent to the upper edge thereof for receiving the locking tab when the top panel is folded to at least partially enclose the carton, and means for urging the top panel upwardly and positively engaging the locking tab with the slot. The means for urging the top panel can comprise an upper gusset panel foldably connected to a second edge of the top panel, and a lower gusset panel foldably connected to a second portion of the upper edge of the side wall, the upper and lower gusset panels being foldably connected by a score line positioned to permit the gusset panels to collapse inwardly when the top panel is folded to at least partially enclose the carton.

More particularly described, the present invention provides, in a carton including a pair of side walls held in spaced apart relation by a pair of end walls at corners of the carton, and a pair of top panels foldably connected to the end walls and foldable toward one another to enclose the carton, the improvement comprising a plurality of upper gusset panels foldably connected to the top panels and a plurality of lower gusset panels foldably connected to the side panels, the upper and lower gusset panels being joined by a score line extending diagonally from the intersection of a top panel, a side wall, and an end wall; a pair of locking tabs formed at the outer corners of each of the top panels; and the side walls defining slots located at the upper central portions of the side walls for receiving the locking tabs when the top panels are folded toward one another to enclose the carton.

The carton can further comprise handle members formed at the ends of the top panels, and the locking tabs can be positioned at the opposite sides of the handle members. The foldable connections between the upper gusset panels and the top panels, and between the side walls and the end walls, preferably define colinear score lines at each corner of the carton prior to the top panels being folded toward one another. The distance between the colinear score lines, when measured across the end walls, preferably diverges from the bottom of the carton to the locking tabs. This configuration gives the container an improved appearance by causing the side walls to bow outwardly at the center of the container.

The invention also comprises a one-piece blank for formation of the carton embodying the invention. The colinear score lines are preferably positioned to allow the carton to collapse to a flat configuration, and an automatic bottom closure can be foldably connected to the side and end walls to form the bottom of the carton when the carton is erected.

Thus, it is an object of the present invention to provide an improved top-loading carton with integrally formed top closure panels.

It is a further object of the present invention to provide an improved top-loading carton having improved top panel locking means.

It is a further object of the present invention to provide an improved top-loading carton having a unique aesthetic appearance.

It is a further object of the present invention to provide an improved top-loading carton which provides better protection of its contents.

It is a further object of the present invention to provide an improved top-loading carton that can be easily carried from place to place.

Other objects, features and advantages of the present invention will become apparent upon reading the following detailed description of an embodiment of the invention, when taken in conjunction with the drawing.

DETAILED DESCRIPTION

Figure 1:
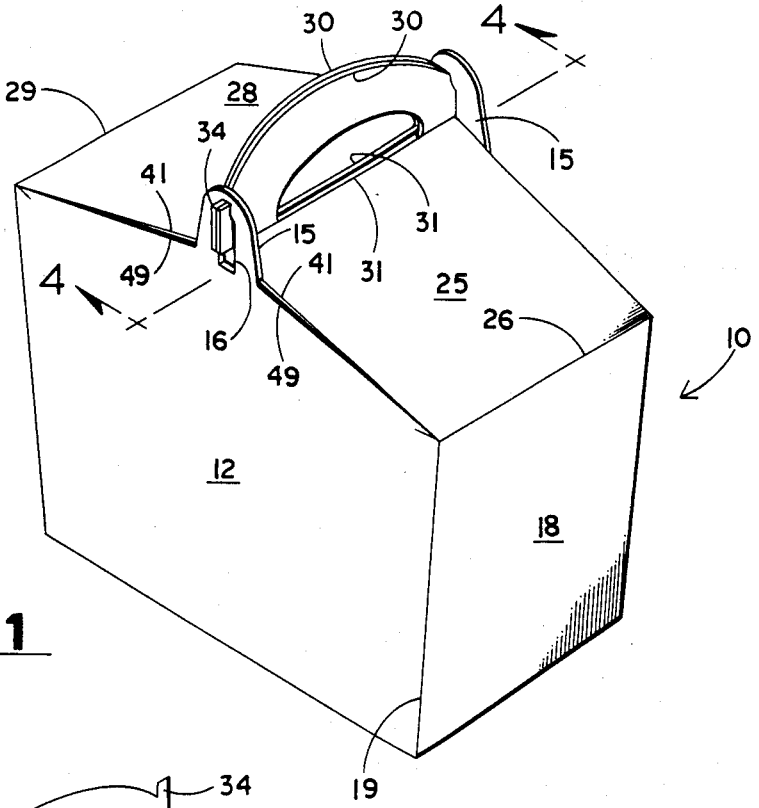
FIG. 1 is a pictorial view of a carton embodying the invention.

Referring now to the drawing, in which like numerals refer to like parts thorughout the several views, FIG. 1 shows a carton 10 embodying the invention. The carton is constructed from a one-piece blank shown in FIG. 5. A first side wall 12 and a second side wall 14 each define a projection 15 extending upwardly from the upper central portion of the side walls. An elongate vertical slot 16 is formed in the projection 15, and the slot 16 extends from a point above the top edge of the side wall 12 or 14 to a point below the top edge. Preferably, the upper end of the slot 16 tapers to a point 17.

The first side wall 12 is foldably connected to a first end wall 18 by a score 19 which defines side edges of both the side wall 12 and the end wall 18. A second end wall 20 is foldably connected to the first side wall 12 and the second side wall 14 by scores 21 and 22, respectively. The scores 21 and 22 define side edges of the side walls and second end wall. A lower glue flap 23 is foldably connected to a side edge of the second side wall 14 by a score 24, and is positioned to be adhered to the first end wall 18 in a manner described below.

Figure 5:
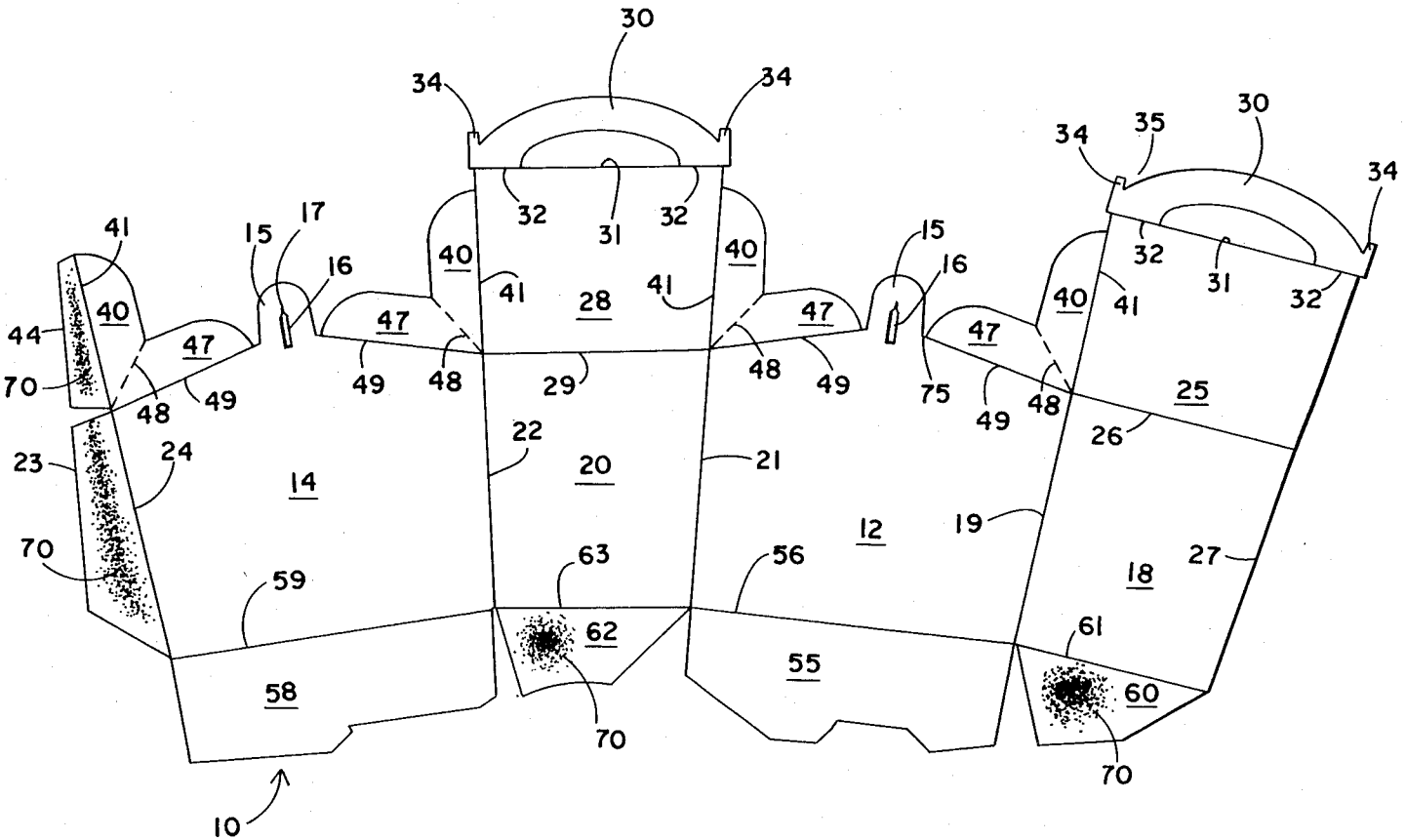
FIG. 5 is a plan view of a paperboard blank from which the carton of FIG. 1 is erected.

A first top panel 25 is foldably connected to the top edge of the first end panel 18 along a score 26. The top panel 25 defines a side edge that is colinear with the score 19 on the flat blank. Also, the top panel 25 and end wall 18 share a colinear free edge 27. Similarly, a second top panel 28 is foldably connected to the top edge of the second end panel 20 along a score 29. The top panel 28 defines side edges that are colinar with the scores 21 and 22. In the preferred embodiment, the colinear side edges of the end walls and top panels diverge from the bottom to the top of the carton 10, as shown in FIG. 5. The functional result of this configuration is a bowing of the side walls in a manner described below.

Figure 4:
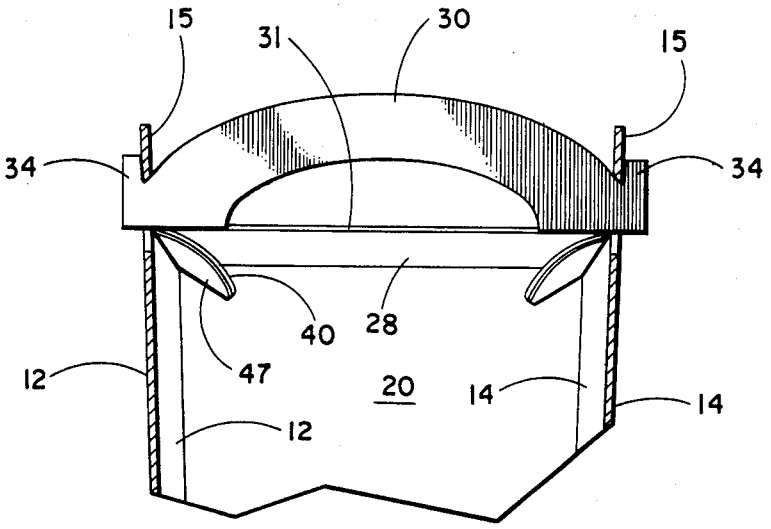
FIG. 4 is a vertical cross sectional view taken along line 4—4 of FIG. 1.

Each of the top panels has a top edge 31 to which is foldably connected a handle member 30 along scores 32 at each end of the handle member. Each handle member defines a pair of upwardly extending locking tabs 34 at each end of the handle member, approximately even with the side edges of each top panel. A recess 35 is formed between the handle members and each locking tab 34. Preferably, the recesses 35 taper downwardly to a sharp point. The locking tabs are received within the slots 16, as best shown in FIGS. 1 and 4, and as described below.

The top panels 25 and 28 are connected to the side walls 12 and 14 by a gusset construction consisting of a plurality of upper gusset panels 40 and lower gusset panels 47. Upper gusset panels 40 are foldably connected along scores 41 to both side edges of the top panel 28, to the side edge of the top panel 25 opposite the free edge 27, and to an upper glue flap 44 positioned above the glue flap 23 to be adhered to the free edge of the first top panel 25. The lower gusset panels 47 are foldably connected to the upper gusset panels 40 along diagonal scores 48, which may be further weakened by spaced apart cuts along the scores. The lower gusset panels 47 are also foldably connected to the top edges of the side walls along scores 49 which extend to a position adjacent to the projection 15 of the particular side wall. It will be seen from the drawing that each set of scores 40, 48, and 49 associated with each set of gusset panels meet at an upper corner of the carton 10, that is, at the intersection of a top panel, a side wall and an end wall of the erected carton.

The collapsibility of the carton 10 will be described below. In connection therewith, a set of conventional automatic bottom panels is provided. Panels 55 and 58 are foldably connected to bottom edges of side walls 12 and 14 along scores 56 and 59, respectively. Cooperating panels 60 and 62 are foldably connected to bottom edges of end walls 18 and 20 along scores 61 and 63, respectively.

To utilize the carton 10, the blank shown in FIG. 5 is first assembled into a flattened configuration suitable for shipping. First, the automatic bottom panels 55, 58, 60, 62 are folded upwardly from their position in FIG. 5 against the wall panels in the conventional manner for forming an automatic closure. Spots of glue 70 are applied to the panels 60 and 62, and a strip of glue 70 is deposited along the glue flaps 23 and 44. The scores 19, 21, 22, 24 and the edge 27 are positioned such that the blank can be folded along score 22 onto itself, and thereafter folded along score 19, resulting in the end wall 18 and top panel 25 being adhered to the glue flaps 23 and 44. The edge 27 then matches the score 24. At the same time, the bottom panel 55 is adhered to the panel 60, and the panel 58 is adhered to the panel 62 in the conventional manner for an automatic bottom. The scores 21 and 24 lie parallel to one another when the blank is assembled in flattened form to permit the hinge-like motion necessary for the flattened carton to move into an erected configuration.

Figure 2:
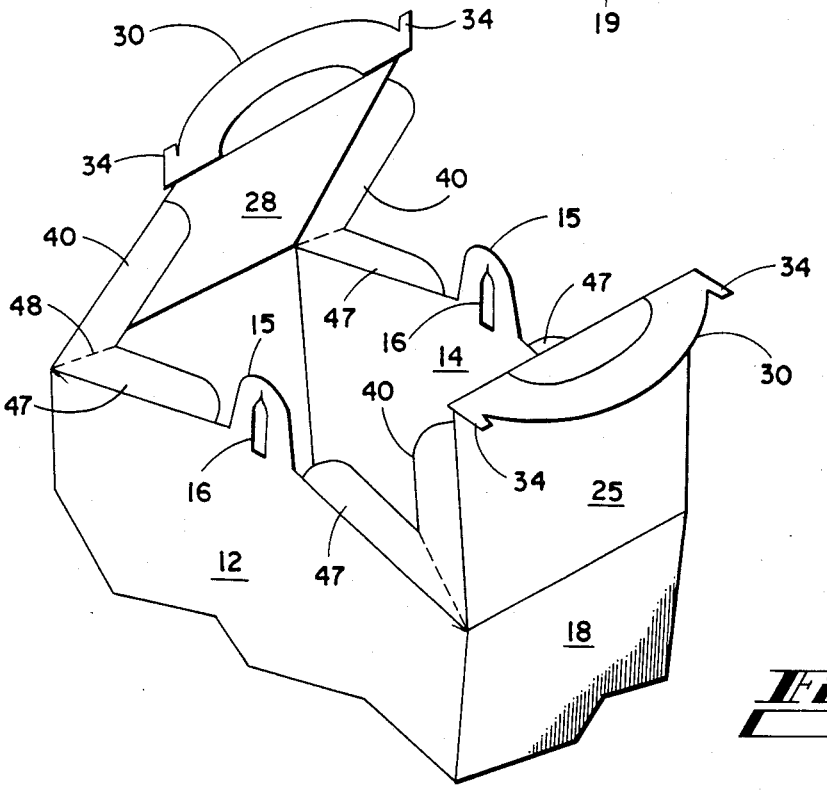
FIG. 2 is a pictorial view of the carton of FIG. 1 with the top panels shown in a partially closed position.

The carton 10 is then ready for shipping and handling, and ultimate use. When it is desired to erect the carton 10 for loading, pressure is applied inwardly to the scores 19 and 22, which causes the automatic bottom panels to slide past one another and lock the carton in the erected configuration in a well known manner. In the initial erected but open configuration, the carton 10 is ready for loading. The gusset panels cause the carton to be erected with the cover panels held in a rigid, open position, which facilitates loading. After the contents have been loaded, the top panels 25 and 28 are closed as shown in FIG. 2. The gusset panels 40, 47 are folded inwardly as shown in FIGS. 2 and 4, while the top panels are folded downwardly about the scores 26 and 29. The gusset panels maintain the cover panels in a flat configuration without bowing during and after the closing operation. The gusset panels also cause the folds along scores 41 and 49 to meet in alignment without gaps that could occur between the cover and side panels if the gusset panels were not present. When the scores 41 come into proximity to the scores 49, the handle members 30 meet in the center of the carton as shown in FIG. 1. The locking tabs 34 are lowered against the pressure of the folded gusset panels to a position in which they can be inserted through the slots 16 on each side of the carton. Once the locking tabs are inserted, pressure is released and the tabs move upwardly until the projections 15 are deeply engaged in the recesses 35 between the tabs 34 and the handle members 30, as shown in FIG. 4.

In this configuration, the handle members 30 are held together for ease of grasping, and the top panels 25, 28 are securely locked in place closing the carton. The gusset panels 40, 47 are constructed such that they tend to separate from one another, and thereby urge the locking tabs into firm engagement with the slots 16 of the projections 15. This prevents the projections 15 from being inadvertently disengaged from the locking tabs. The gusset panels also provide a pleasing appearance at the joint between the top panels and the side walls, rather than a raw paperboard edge, and more fully enclose the carton by reducing air passageways as compared to the prior art. This may be important, for example, if the contents are heated and it is desired to maintain the heat within the carton during transportation thereof.

A consumer opens the loaded carton by pressing the cover panels downwardly and pulling the projections 15 outwardly to release the tabs 34. The gusset panels maintain the cover panels in a roughly vertical position when they are opened. However, the user can break the gusset panels apart along the perforated scores 48, if desired. This allows the cover panels to be folded down out of the way to facilitate access to the contents.

Figure 3:
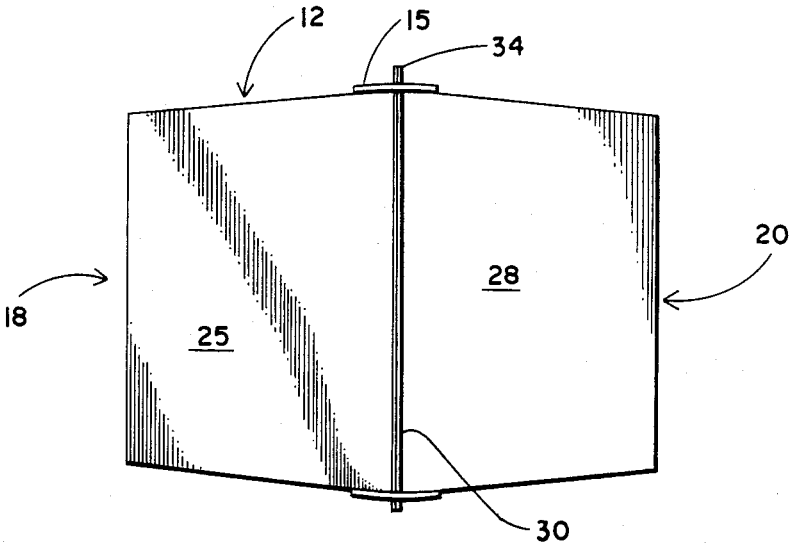
FIG. 3 is a top plan view of the carton of FIG. 1.

The tapering shape of the top panels 25 and 28 gives the carton a unique shape best shown in FIG. 3, a top plan view. Since each top panel is wider at its top edge 31 than at its bottom edge along score 26 or 29, the central portions of the side walls 12 and 14 are bowed outwardly. Achievement of this curved shape is assisted by the gusset panels which transmit the force of the top panels to the side walls. By terminating the lower gusset panels 47 a short distance 75 from the projections 15, as shown in FIG. 1, the transition across the corners of the top panels is smoothed. The carton 10 thus has an appearance of fullness and a line that is less severe than the flat surfaces and angles of prior cartons of the same type.

In the preferred embodiment shown, the side edges of the side walls 12 and 14 are tapered, so that the mouth of the carton 10 is larger than the bottom formed by the automatic bottom panels. The top edges of the side walls are preferably angled upwardly from each side edge to the projection 15, as shown. Although in the preferred form, the side walls are longer than the end walls, resulting in a rectangular bottom, the principles of the invention can be applied to a square or other cross sectional shape. The advantages of the gusseted top panels in conjunction with the locking tabs can be obtained with or without providing handle members at the top edges of one or both of the top panels.

While this invention has been described in detail with particular reference to a preferred embodiment thereof, it will be understood that variations and modifications can be made without departing from the spirit and scope of the invention, as defined in the appended claims.

I claim:

1. In a carton including a pair of side walls held in spaced apart relation by a pair of end walls at corners of said carton, and a pair of top panels foldably connected to said end walls and foldable toward one another to enclose said carton, the improvement comprising:

a plurality of upper gusset panels foldably connected to said top panels and a plurality of lower gusset panels foldably connected to said side walls, said upper and lower gusset panels being joined by a score line extending diagonally from the intersection of a top panel, a side wall, and an end wall;

a pair of locking tabs formed at the outer corners of each of said top panels; and said side walls defining slots located at the upper central portions of said side walls for receiving said locking tabs when said top panels are folded toward one another to enclose said carton.

2. The carton of claim 1, further comprising handle members formed at the ends of said top panels, and wherein said locking tabs are positioned at the opposite sides of said handle members.

3. The carton of claim 1, wherein the foldable connections between said upper gusset panels and said top panels, and between said side walls and said end walls, define colinear score lines at each corner of said carton prior to said top panels being folded toward one another.

4. The carton of claim 3, wherein the distance between said colinear score lines, when measured across said end walls, diverges from the bottom of said carton to said locking tabs such that when said top panels are folded toward one another to enclose said carton, said side panels bow outwardly.

5. The carton of claim 3, wherein said colinear score lines are positioned to allow said carton to collapse to a flat configuration; and further comprising an automatic bottom closure foldably connected to said side and end walls.

6. The carton of claim 1, wherein said gusset panels urge said top panels upwardly when said top panels are folded to enclose said carton.

7. The carton of claim 6, wherein said gusset panels urge said top panels upwardly when said top panels are folded to enclose said carton.

8. The carton of claim 1, wherein said gusset panels urge said side panels outwardly when said top panels are folded to enclose said carton.

9. The carton of claim 8, further comprising slot projections extending upwardly from the upper edge of each of said side walls, said slot projections defining said slots.

10. A blank of paperboard or the like for forming a carton, comprising:

a first side wall having a top edge, a bottom edge, and a pair of side edges;

a first end wall foldably connected along a side edge thereof to a side edge of said first side wall, and having a top edge, a bottom edge, and a free side edge;

a second side wall having a top edge, a bottom edge, and a pair of side edges;

a second end wall foldably connected along side edges thereof to side edges of both said first and second side walls, and having a top edge and a bottom edge;

a lower glue flap foldably connected to a side edge of said second side wall opposite said second end wall;

a first top panel foldably connected along a bottom edge thereof to the top edge of said first end wall, and having a top edge and a pair of side edges, one of said first top panel side edges being a free side edge;

a second top panel foldably connected along a bottom edge thereof to the top edge of said second end wall, and having a top edge and a pair of side edges;

each of said top panels including handle members foldably connected to the top edges of said top panels, said handle members defining locking tabs at opposite ends thereof;

a first slot projection extending upwardly from a central portion of said first side wall and defining therein a slot extending from a point below the top edge of said first side wall to a point above the top edge of said first side wall;

a second slot projection extending upwardly from a central portion of said second side wall and defining therein a slot extending from a point below the top edge of said second side wall to a point above the top edge of said second side wall;

a plurality of lower gusset panels foldably connected to the top edges of said first and second side walls from a position adjacent to said slot projections to the side edges of said side walls;

a plurality of upper gusset panels foldably connected along diagonal scores to said lower gusset panels and to the side edges of said second top panel, to the non-free edge of said first top panel, and to an upper glue panel positioned above said lower glue panel;

said side edges of said top panels being colinear with corresponding side edges of said end wall;

the distance between said colinear edges measured across said end walls diverging from bottom to top;

said side edges being positioned to allow said carton to be assembled by adhering said upper and lower glue flaps to said first top panel and first end wall, respectively, such that said assembled carton can be collapsed into a flat configuration; and automatic bottom panels foldably connected to the bottom edges of said side and end walls.

* * * * *